US006114936A

United States Patent [19]

Yamamoto et al.

[11] Patent Number: 6,114,936

[45] **Date of Patent: *Sep. 5, 2000**

[54] MULTILAYER COIL AND MANUFACTURING METHOD FOR SAME

[75] Inventors: Shigekatsu Yamamoto, Fukui-ken; Katsuyuki Uchida, Hikone, both of Japan

[73] Assignee: Murata Manufacturing Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/083,817

[22] Filed: May 22, 1998

[30] Foreign Application Priority Data

May 23, 1997 [JP] Japan ..... 9-133481

[51] Int. Cl.[7] ..... H01F 27/29; H01F 27/30

[52] U.S. Cl. ..... 336/192; 336/200; 336/225; 336/232

[58] Field of Search ..... 336/200, 232, 336/227, 192, 223, 225, 228

[56] References Cited

U.S. PATENT DOCUMENTS

| | | | |
|---|---|---|---|
| 4,641,114 | 2/1987 | Person | 336/200 |
| 4,803,453 | 2/1989 | Tomono et al. | 336/200 |
| 5,392,019 | 2/1995 | Ohkubo | 336/200 |

FOREIGN PATENT DOCUMENTS

| | | | |
|---|---|---|---|
| 58-21806 | 2/1983 | Japan | 336/200 |
| 59-58805 | 4/1984 | Japan | 336/200 |
| 2-101715 | 4/1990 | Japan | 336/200 |
| 2-146409 | 12/1990 | Japan | 336/200 |

*Primary Examiner*—Thomas J. Kozma
*Attorney, Agent, or Firm*—Keating & Bennett, LLP

[57] ABSTRACT

A multilayer coil has a significantly reduced size but still provides a large inductance and a high Q-value. The multilayer coil includes insulative sheets which are respectively provided with coil conductors and via holes and which are laminated and fired. The coil conductors are electrically connected in series through the via holes so as to form a spiral coil. The via holes are disposed at approximately central portions of the side edge surface at the rear of the multilayer type coil, while the via holes are disposed at approximately central portions of the side edge surface at the front thereof.

7 Claims, 6 Drawing Sheets

MULTILAYER COIL AND MANUFACTURING METHOD FOR SAME

BACKGROUND OF THE INVENTION

1. Field of the Invention

The present invention relates to a multilayer coil and, more particularly, to a multilayer coil which is constructed to be incorporated in high-frequency electronic equipment or the like, and a manufacturing method for making such a multilayer coil.

2. Description of Related Art

An example of a conventional multilayer coil is shown in FIG. 9. A multilayer coil 1 shown in FIG. 9 is formed by laminating a plurality of insulative sheets 3, each of which is provided with a coil conductor 2 on a surface thereof, adding protective sheets 4 and 5 at the top and bottom of the laminate, and then firing the laminate. The respective coil conductors 2 are electrically connected to each other in series through via holes 6 provided in the insulative sheets 3 so as to form a spiral coil 10. Both ends 10*a* and 10*b* of the spiral coil 10 are respectively connected to external electrodes 7 and 8 provided at the right and left ends of the multilayer type coil 1 as illustrated in FIG. 10.

Generally, as the inside diameter of the spiral coil 10 is increased, the inductance obtained accordingly increases with increasing Q-value. On the other hand, it is desirable that the size of the multilayer coil 1 is as small as possible. However, as the size of the multilayer coil 1 is decreased, the inside diameter of the incorporated coil is inevitably decreased, resulting in a smaller inductance and Q-value. Therefore, in order to obtain a large inductance and a large Q-value from a compact multilayer type coil, the decrease of the inside diameter of the spiral coil 10 must be minimized. For this reason, attempts have been made in conventional multilayer coil 1 to minimize the gap between the coil conductors 2 and the peripheral edges of the sheets 3.

However, the attempts to minimize the gap between the coil conductors and the peripheral edges of the sheets upon which they are formed have been hindered because of the conventional belief that the gap between the coil conductors 2 and the peripheral edges of the sheets 3 in the conventional devices must be at least about 50 $\mu$m for a widthwise gap g1 of the sheets 3 to ensure printing accuracy and insulation reliability of the coil conductors 2. Also, in the conventional coils, a lengthwise gap g2 of the sheets 3 must be usually 100 $\mu$m or more in order to prevent deterioration in the characteristics of the multilayer coil 1 caused by the stray capacitance generated between the external electrodes 7 and 8 and the coil conductors 2. Hence, the coil diameter of the multilayer type coil 1 has been significantly smaller in relation to the external size of the multilayer coil 1. As a result, it is difficult to obtain a large inductance and Q-value. Furthermore, the coil conductors of most multilayer coils are shaped such that they are rectangular and have four corners defining right angles. This construction has also contributed to a low Q-value.

SUMMARY OF THE INVENTION

To overcome the problems discussed above, the preferred embodiments of the present invention provide a multilayer coil which is compact and has a significantly reduced size, but is still able to provide a large inductance and a high Q-value.

According to preferred embodiments of the present invention, there is provided a multilayer coil in which a plurality of coil conductors and insulating layers are laminated to construct a multilayer unit which incorporates a coil defined by connecting the coil conductors in series via the openings provided in the insulating layers, the openings being located at the side edge surfaces of the multilayer unit.

The construction described above allows a larger diameter of coil to be used since the openings are provided at the side edge surfaces of the multilayer unit so as to reduce the gap between the side surfaces and the coil conductors to zero. Although it was conventionally believed that the coil conductors must be a minimum distance from the side surfaces of a multilayer unit, the preferred embodiments of the present invention provide a novel configuration in which the gap between the side surfaces and the coil conductors is reduced to zero, while avoiding the problems with printing accuracy and insulation reliability of the coil conductors and stray capacitance experienced in conventional devices when the gap was reduced below 50 $\mu$m in a widthwise direction and below 100 $\mu$m in the lengthwise direction.

A manufacturing method for the multilayer type coil in accordance with preferred embodiments of the present invention includes the steps of laminating a plurality of insulative mother sheets provided with a plurality of coil conductors arranged in a matrix pattern on the surfaces thereof so as to form a mother multilayer unit, connecting the plurality of coil conductors in series via a plurality of openings provided in the insulative mother sheets to form a plurality of coils arranged in a matrix pattern in the mother multilayer unit, and cutting the mother multilayer unit along cutting lines, which extend across approximate centers of the plurality of openings, into pieces of a predetermined size.

The multilayer coil which has the openings provided at the side edge surfaces of the multilayer unit is efficiently manufactured by cutting the mother multilayer unit into the pieces of the predetermined size at the cutting lines which extend across the approximate centers of the openings as described above.

Other features and advantages of the present invention will become apparent from the following description of the invention which refers to the accompanying drawings.

DETAILED DESCRIPTION OF PREFERRED EMBODIMENTS

Preferred embodiments of the multilayer coil and the manufacturing method for the same will now be described with reference to the accompanying drawings.

Figure 1:
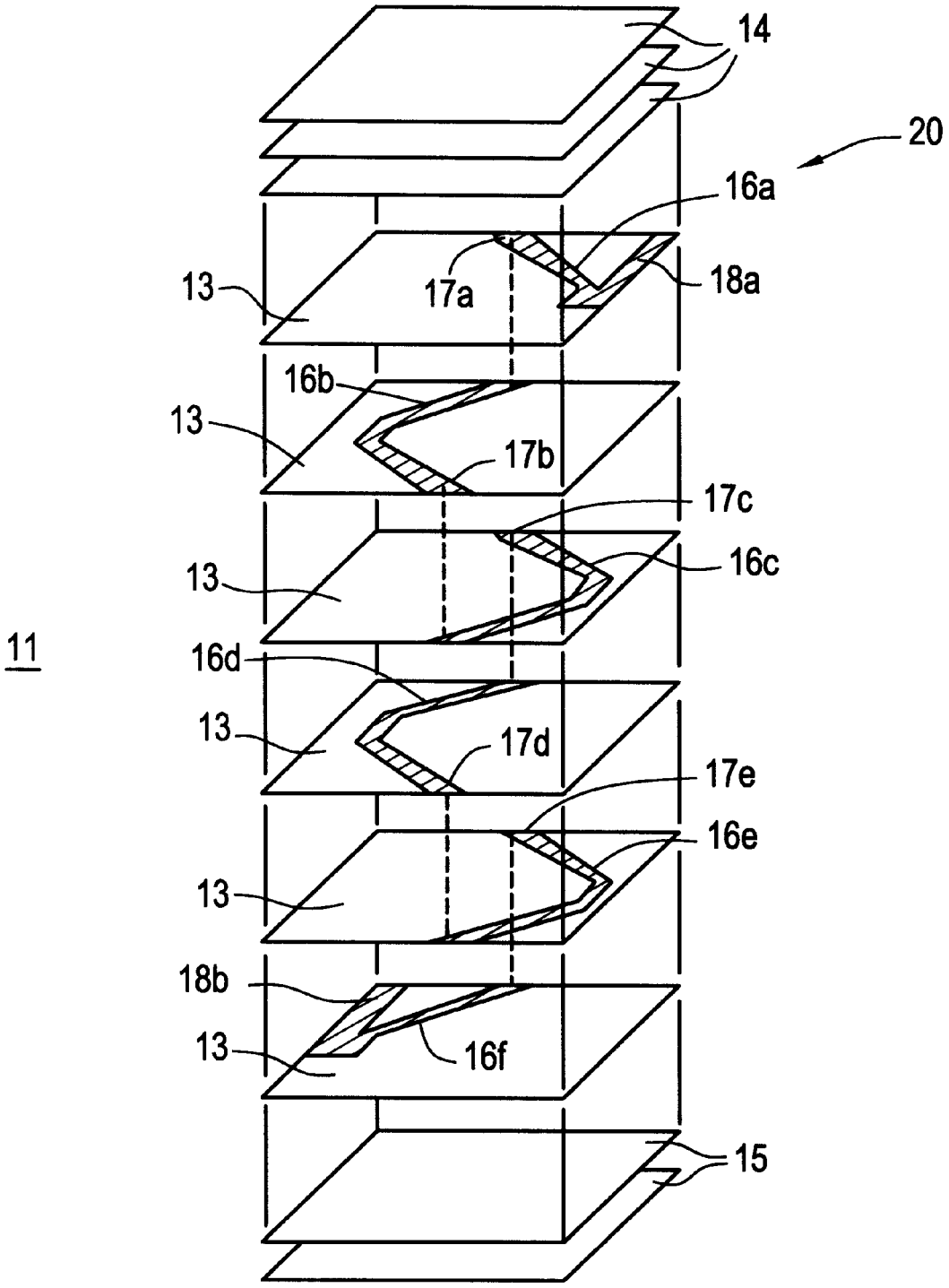
FIG. 1 is an assembly view of a preferred embodiment of the multilayer coil in accordance with the present invention.

As shown in FIG. 1, a multilayer coil 11 is preferably made by laminating insulative sheets 13 respectively provided with coil conductors 16*a* through 16*f* and via holes or openings 17*a* through 17*e* with protective sheets 14 and 15 disposed at the top and the bottom of the laminate, then by firing the laminate. The coil conductors 16*a* through 16*f* are electrically connected to each other in series through the via holes 17*a* through 17*e* to define a spiral coil 20. Each of the coil conductors 16*b* through 16*e* is preferably arranged to have a ½-turn pattern which is approximately V-shaped to make the cross-sectional shape of the spiral coil 20 nearly round so as to provide a good Q characteristic. In other words, the corners of the coil 20 are obtuse angles in contrast to the right angles of the conventional coils. One end of the coil conductor 16*a* is connected to a lead electrode 18*a* exposed at the right side of the sheet 13 and one end of the coil conductor 16*f* is connected to a lead electrode 18*b* exposed at the left side of the sheet 13.

The insulative, substantially rectangular sheets 13 through 15 are preferably made by kneading a nonmagnetic material such as ceramic powder and a magnetic powder such as ferrite together with a binder or the like and by forming the mixture into sheets. The via holes 17*a*, 17*c*, and 17*e* are arranged to be exposed at the approximate central portions of the rear side edges of the sheets 13. The via holes 17*b* and 17*d* are arranged to be exposed at the approximate central portions of the front side edges of the sheets 13.

Figure 3:
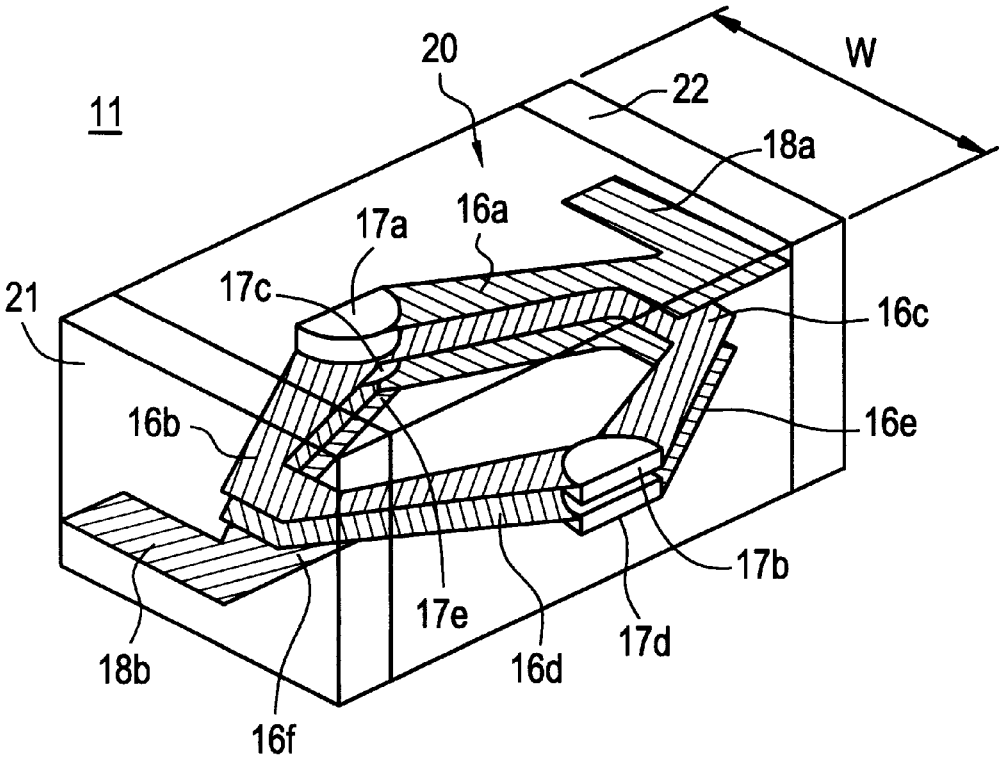
FIG. 3 is a perspective view showing the interior of the multilayer coil of FIG. 1.

It is noted that the shape of the via holes 17*a* through 17*d* shown in FIG. 3 are preferably substantially semi-circular. However, the preferred embodiments of the present invention may includes via holes having a variety of shapes and configurations, as long as the via holes are located at side edge portions of the sheets 13.

Figure 2:
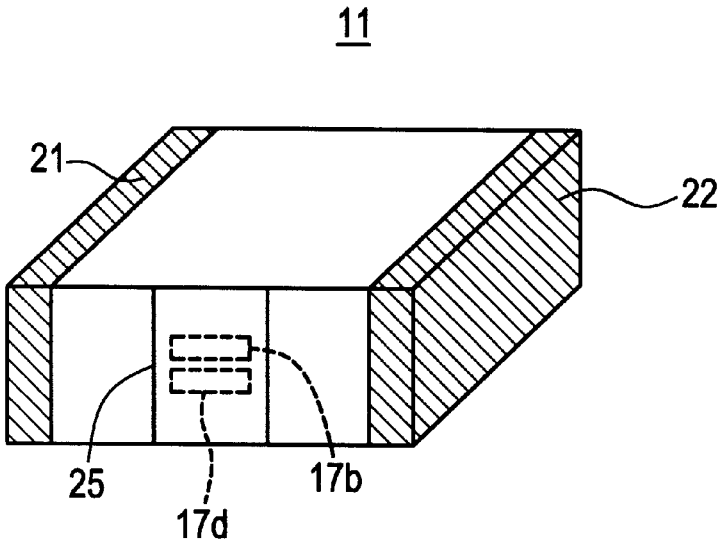
FIG. 2 is a perspective view showing the appearance of the multilayer coil of FIG. 1.

As shown in FIG. 2, the sheets 13 through 15 are stacked to define a multilayer unit. The via holes 17*a*, 17*c*, and 17*e* are provided at the back side edge surface of the multilayer unit, while the via holes 17*b* and 17*d* are provided on the front side edge surface of the multilayer unit. The via holes 17*a* through 17*e* are covered with insulative films 25 to ensure high insulation reliability and to avoid the problems with insulation reliability experienced in prior art devices.

External electrodes 21, 22 are disposed on the right and left end surfaces of the multilayer coil 11. As illustrated in FIG. 3, the external electrode 21 is electrically connected to one end of the coil 20, namely, an end of the coil conductor 16*f*, via the lead electrode 18*b*. The external electrode 22 is electrically connected to the other end of the coil 20, namely, an end of the coil conductor 16*a*, via the lead electrode 18*a*.

In the multilayer coil 11 configured as described above, the respective via holes 17*a* through 17*e* are positioned at the approximate central portions of the rear or front side edges of the sheets 13. As a result of this arrangement, the gap between the side edges of the sheets 13 and the coil conductors 16*a* through 16*f* is reduced to zero in the direction of width W of the sheets 13 (see FIG. 3). Therefore, the diameter of the coil 20 can be increased to a value nearly equal to width W of the sheets 13, allowing inductance L and Q-value to be significantly increased accordingly.

Table 1 shows the measurement results of inductance L, Q-value, and stray capacitance of the multilayer coil 11 in accordance with preferred embodiments of the present embodiment. For the purpose of comparison, the measurement results of a conventional multilayer type coil are also shown.

TABLE 1

| | L (nH) | Q-value (1 GHZ) | Stray Capacity (pF) |
|---|---|---|---|
| Preferred Embodiment | 18 | 45 | 0.162 |
| Conventional | 12 | 35 | 0.156 |

From Table 1, it is seen that the coil 11 of the preferred embodiments of the present invention achieves a 50% improvement in inductance L and an improvement of 25% in Q-value, while showing little change in stray capacitance, as compared to the conventional coil.

Figure 4:
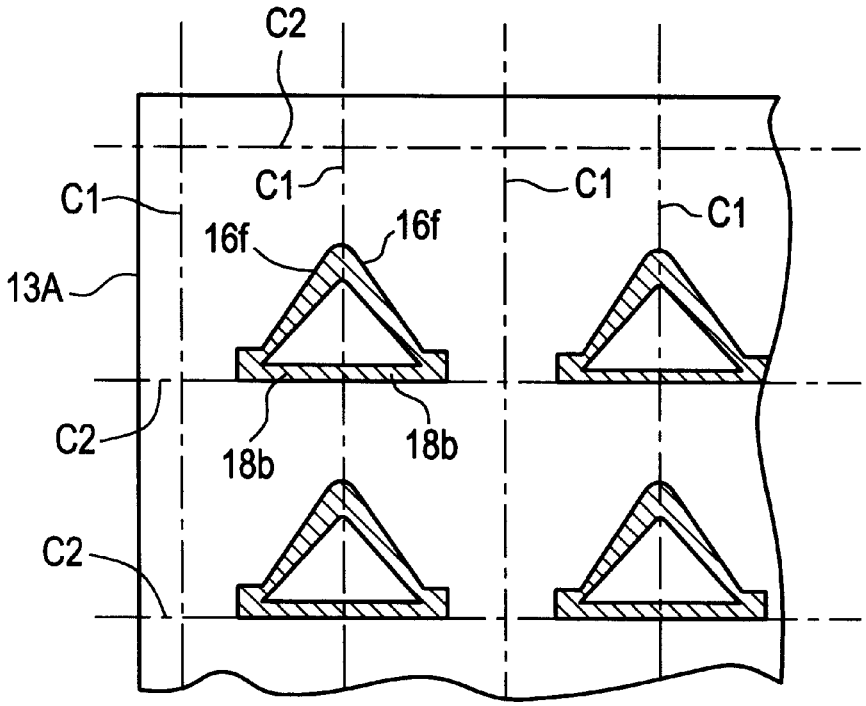
FIG. 4 is a top plan view of the coil conductors printed in a matrix pattern on a sheet member, which may be used for the multilayer coil of FIG. 1.

A preferred manufacturing method for the multilayer type coil 11 will now be described, referring to FIG. 4 through FIG. 7. A plurality of mother sheets 13A composed of an insulator material are prepared, then the lead electrodes 18*b* and the coil conductors 16*f* are provided in a matrix pattern on one of the mother sheets 13A by applying a conductive paste or the like as illustrated in FIG. 4. The coil conductors 16*f* and the lead electrodes 18*b* are preferably made of Ag, Pd, Ag—Pd, Cu, or other suitable material. The coil conductors 16*f* are disposed on the surface of the mother sheet 13A by a well-known printing technique or other suitable technique.

Figure 5:
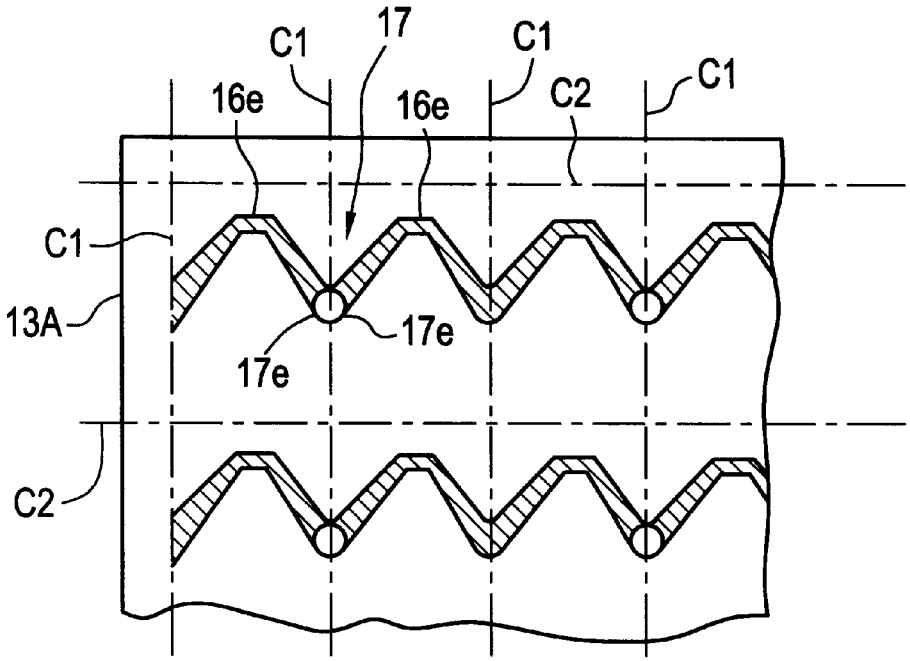
FIG. 5 is a top plan view showing another type of coil conductor printed in a matrix pattern on a sheet member, which may be used for the multilayer coil of FIG. 1.

Then, the holes for defining via holes are formed in another mother sheet 13A by punching or the like as shown in FIG. 5. After that, the conductive paste or the like is applied to the mother sheet 13A by a printing process or other method to form the coil conductors 16*e* in the matrix pattern on the mother sheet 13A. At this time, the holes for defining via holes are also filled with the conductive paste to define the via holes 17.

Figure 6:
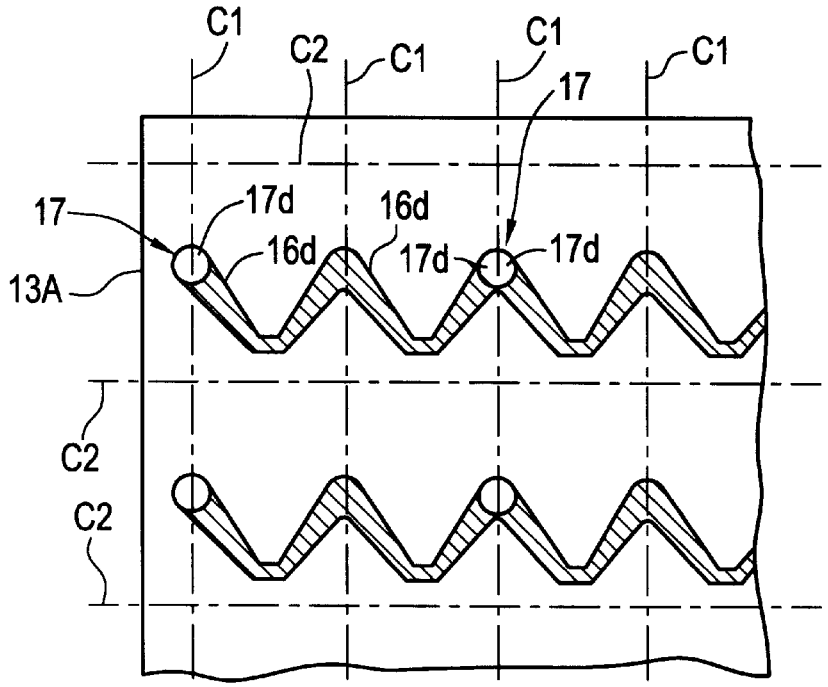
FIG. 6 is a top plan view of still another type of coil conductor printed in a matrix pattern on a sheet member, which may be used for the multilayer coil of FIG. 1.

As shown in FIG. 6, the holes for defining via holes are formed in still another mother sheet 13A by punching or the like. After that, by using the holes as the references, the conductive paste or the like is applied to the mother sheet 13A by a printing process or the like to form the coil conductors 16*d* in the matrix pattern on the mother sheet 13A. At this time, the holes for defining via holes are also filled with the conductive paste to form the via holes 17. In a similar manner, the mother sheets 13A, each of which is provided with the via holes 17 and the coil conductors 16*c* and 16*b*, are produced.

Figure 7:
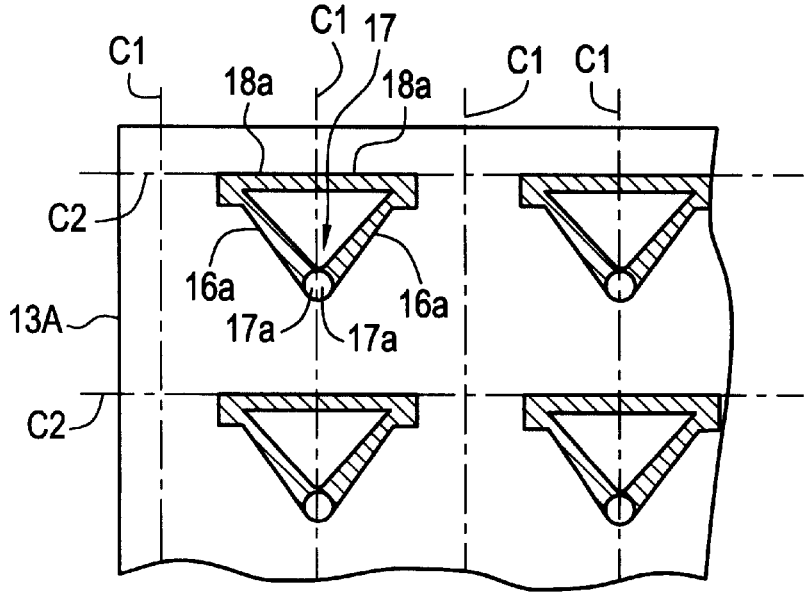
FIG. 7 is a top plan view of yet another type of coil conductor printed in a matrix pattern on a sheet member, which may be used for the multilayer coil of FIG. 1.

Further, as shown in FIG. 7, holes for via holes are formed in yet another mother sheet 13A and the conductive paste or the like is applied to the mother sheet 13A by the printing process or the like so as to fabricate the mother sheet 13A provided with the via holes 17, the coil conductors 16*a*, and the lead electrodes 18*a*.

The respective mother sheets 13A thus obtained are laminated in order, the protective mother sheets are attached to the top and bottom of the laminate, and the laminate is press-bonded to complete the mother multilayer unit. Then, as illustrated in FIG. 4 through FIG. 7, the mother multilayer unit is cut into product pieces of a predetermined size along cutting lines C1 extending across the approximate centers of the aligned via holes 17 and along cutting lines C2 which are preferably substantially perpendicular to the cutting lines C1 and located at the middle between adjoining via holes 17. Glass paste or the like is applied to form insulative films 25 so as to cover the via holes 17*a* through 17*e* exposed on the side edge surfaces of the multilayer units which have been cut out. The insulative films 25, however, need not be limited to the areas of the via holes 17*a* through 17*e* but may be formed on the entire surface of the multilayer unit excluding the areas of the external electrodes 21 and 22.

In the next step, the external electrodes 21 and 22 are disposed on both ends of the multilayer unit by dipping, printing, or other suitable method. After that, the multilayer unit is integrally fired. At this time, the insulative films 25 and the external electrodes 21 and 22 are attached by baking. Then, the surfaces of the external electrodes 21 and 22 are plated with solder, nickel, etc. in order to improve mechanical strength and solderability.

In the multilayer type coils thus obtained, the single via hole 17 is divided into two via holes 17*a* of the two multilayer type coils 11, permitting the via holes 17*a* through 17*e* to be efficiently formed.

The multilayer coil and the manufacturing method for the same in accordance with the present invention are not limited to the preferred embodiments described above. It is apparent that a plurality of different working modes can be formed on the basis of this invention without departing from the spirit and scope of the invention.

In the embodiments described above, the insulative sheets, each of which is provided with the coil conductors, are laminated and fired to define a single unitary element. The present invention, however, is not limited thereto. Sheets sintered in advance may be used instead.

The multilayer coil may alternatively be fabricated by the following manufacturing method: the insulating layer is formed by printing or other methods using a paste insulator material, then a paste conductive material is applied to a surface of the insulating layer in order to form a coil conductor having a desired shape. Next, the paste insulator material is applied onto the coil conductor to produce the insulating layer. In a similar manner, the application is repeated in order to make a coil having a multilayer structure. In this case, it is preferable to form predetermined openings when applying the paste insulator material to connect the respective conductors in series.

Figure 8:
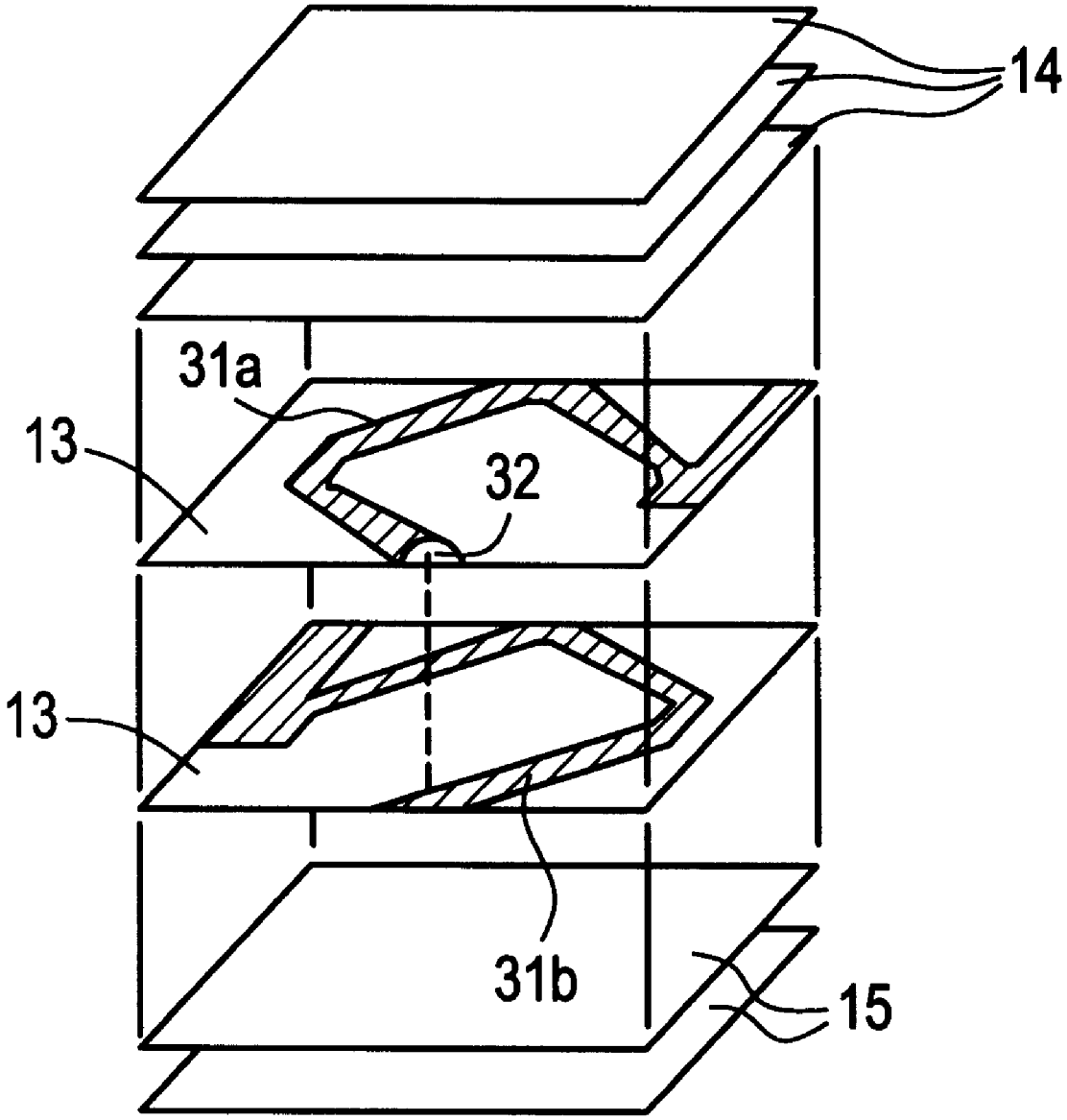
FIG. 8 is an assembly view illustrative of another preferred embodiment of the multilayer coil in accordance with the present invention.
Figure 9:
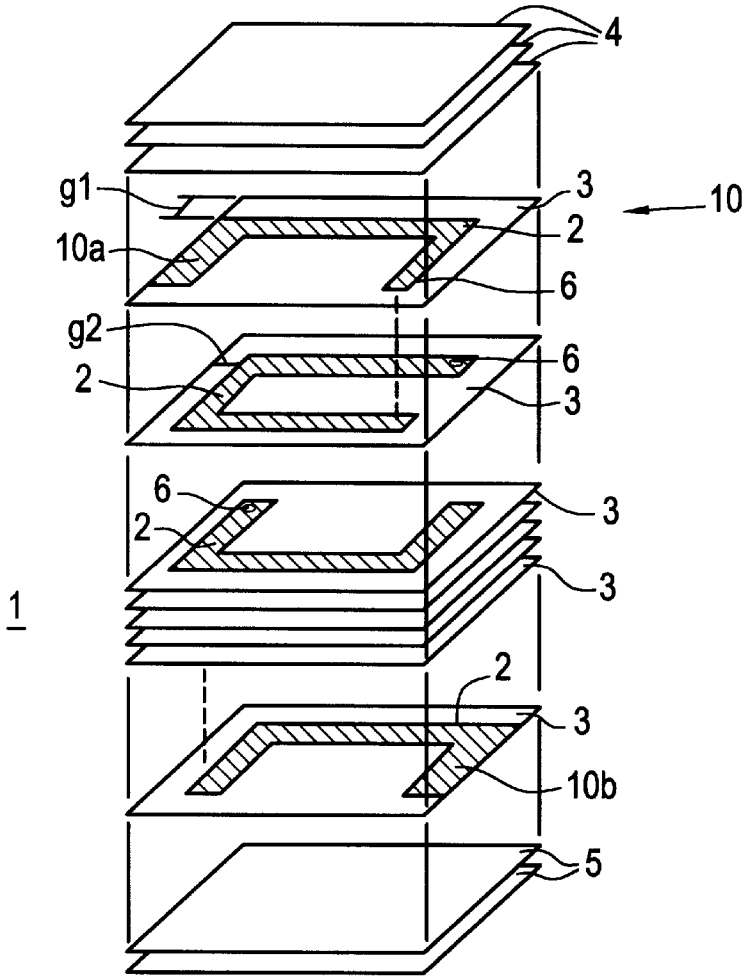
FIG. 9 is an assembly view of a conventional multilayer coil.
Figure 10:
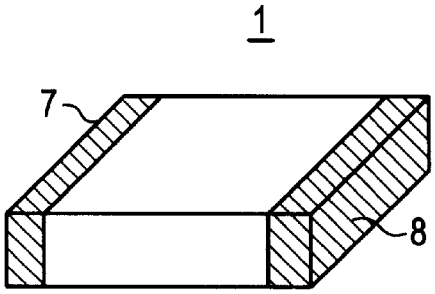
FIG. 10 is a perspective view of the multilayer coil of FIG. 9.

Further, as illustrated in FIG. 8, the insulative sheets 13 provided with coil conductors 31*a* and 31*b*, which have ¾-turn pattern shapes, may be laminated and the coil conductors 31*a* and 31*b* may be electrically connected in series through a via hole 32 provided at a side edge of the sheet 13. This reduces the number of laminated sheets 13, allowing a multilayer type coil to be produced at a lower cost.

Further alternatively, the multilayer type coil may incorporate such components as a capacitor and a resistor.

Thus, according to preferred embodiments of the present invention, since the openings are provided at the side edge surfaces of the multilayer unit, the gap between the side edge surfaces of the multilayer unit can be reduced to zero, allowing a larger diameter of the coil to be achieved. This makes it possible to provide a compact multilayer type coil which achieves a larger inductance and a higher Q-value.

Moreover, the mother multilayer unit is cut into individual pieces of multilayer units having a predetermined size at the cutting lines which include the centers of the openings formed in the mother multilayer unit. Thus, each opening formed in the mother multilayer unit is preferably split into two openings to provide the openings of two multilayer type coils. This enables the openings to be formed efficiently, permitting the cost for forming the openings to be reduced to half. The result is a lower manufacturing cost of the multilayer type coil.

While the invention has been described and particularly shown with reference to preferred embodiments thereof, it will be understood to those skilled in the art that the foregoing and other changes in form and details may be made therein without departing from the spirit and scope of the invention.

What is claimed is:

1. A multilayer coil comprising:

a multilayer unit including a plurality of coil conductors and a plurality of insulating layers having a plurality of openings formed therein, said coil conductors being electrically connected to each other via said openings to define a coil, said openings being located at at least one side edge portion of said multilayer unit, external electrodes located on opposite ends of the multilayer coil and on outer opposite surfaces of the multilayer unit such that the multilayer coil can be surface mounted, and an insulative film disposed between the external electrodes and at areas of the side edge portion of the multilayer unit where said openings are located, wherein said insulative film is arranged to cover said openings and to not cover the external electrodes.

2. The multilayer coil according to claim 1, wherein said plurality of openings each have a substantially semicircular shape.

3. The multilayer coil according to claim 1, wherein each of said coil conductors has a substantially V-shaped configuration.

4. The multilayer coil according to claim 3, wherein corner portions of each of said coil conductors are arranged to have an obtuse angle configuration.

5. The multilayer coil according to claim 1, wherein a first group of said plurality of openings are located at a first side edge of said multilayer unit and a second group of said plurality of openings are located at a second side edge of said multilayer unit.

6. The multilayer coil according to claim 5, wherein said first side edge is disposed opposite to said second side edge.

7. The multilayer coil according to claim 1, wherein said plurality of coil conductors are electrically connected to each other in series.

* * * * *